US007780179B2

(12) United States Patent
Brown

(10) Patent No.: US 7,780,179 B2
(45) Date of Patent: Aug. 24, 2010

(54) DRIVE SYSTEM FOR A HUMAN POWERED VEHICLE

(76) Inventor: Andrew Ramon Brown, 2 Little Priel Road, Weedon, Northants NN7 4PU (GB)

( * ) Notice: Subject to any disclaimer, the term of this patent is extended or adjusted under 35 U.S.C. 154(b) by 137 days.

(21) Appl. No.: 11/572,188

(22) PCT Filed: Jul. 8, 2005

(86) PCT No.: PCT/GB2005/002704

§ 371 (c)(1),
(2), (4) Date: Oct. 16, 2007

(87) PCT Pub. No.: WO2006/008455

PCT Pub. Date: Jan. 26, 2006

(65) Prior Publication Data

US 2008/0164672 A1 Jul. 10, 2008

(30) Foreign Application Priority Data

Jul. 16, 2004 (GB) ..... 0415950.5

(51) Int. Cl.
*B62M 1/14* (2006.01)

(52) U.S. Cl. ..... 280/246; 280/247; 280/248; 280/250.1; 280/242.1; 280/251

(58) Field of Classification Search ..... 280/246, 280/247, 248, 250.1, 242.1, 251
See application file for complete search history.

(56) References Cited

U.S. PATENT DOCUMENTS 1,058,123 A * 4/1913 Whitaker ..... 280/237
4,583,754 A 4/1986 Seeliger (Continued)

FOREIGN PATENT DOCUMENTS

DE 19757270 A1 1/1999

(Continued)

OTHER PUBLICATIONS

Search report of GB Application No. 0415950.5 from the British Patent Office dated Nov. 25, 2004.

*Primary Examiner*—Lesley Morris
*Assistant Examiner*—Marlon A Arce
(74) *Attorney, Agent, or Firm*—Michael Best & Friedrich LLP

(57) ABSTRACT

A drive system (3) for a human powered vehicle. The drive system (3) includes at least one input member (31), a transmission system (21) arranged to convert movement of the input member (31) to rotation of an output member (83), and a lock mechanism (123) including at least one drive member (133) for selectively locking a drive wheel (11, 13) to rotation of the output member (83) for rotation therewith. The drive member (133) is arranged for movement from a first operational position in which the drive wheel (11, 13) is not locked to the output member (83) to a second operational position in which the drive wheel (11, 13) is locked to the output member (83), and back to the first operational position, under the control of a user of the vehicle. The drive system (3) allows the user to choose between propelling the vehicle using the drive system (3) or disengaging the drive system (3) from the drive wheel (11, 13) and propelling the vehicle by some other means, for example by wheel rims.

26 Claims, 7 Drawing Sheets

U.S. PATENT DOCUMENTS

Figure 1B:
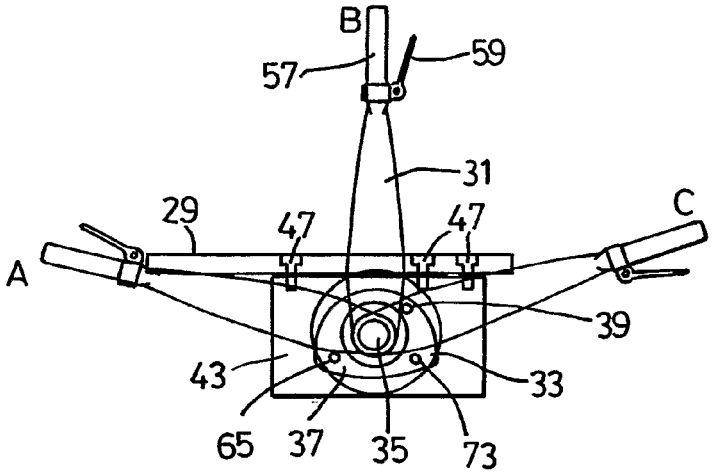

| | | | | |
|---|---|---|---|---|
| 4,758,013 | A * | 7/1988 | Agrillo | 280/250.1 |
| 5,826,897 | A | 10/1998 | Beard | |
| 5,941,547 | A | 8/1999 | Drake | |
| 6,234,504 | B1 * | 5/2001 | Taylor | 280/250.1 |
| 6,237,724 | B1 | 5/2001 | Niedrig | |
| 6,644,443 | B1 | 11/2003 | Jager | |
| 7,195,264 | B2 * | 3/2007 | Drymalski | 280/246 |
| 7,261,309 | B2 * | 8/2007 | Watwood et al. | 280/244 |
| 7,344,146 | B2 * | 3/2008 | Taylor | 280/246 |
| 7,520,519 | B2 * | 4/2009 | Smurthwaite, Jr. | 280/250.1 |
| 2002/0101054 | A1 * | 8/2002 | James | 280/250.1 |
| 2002/0153691 | A1 * | 10/2002 | Liao et al. | 280/250.1 |
| 2003/0071435 | A1 | 4/2003 | Schaeffer et al. | |
| 2005/0067807 | A1 | 3/2005 | Harcourt et al. | |

FOREIGN PATENT DOCUMENTS

| | | |
|---|---|---|
| EP | 0405542 | 1/1991 |
| EP | 0463651 A1 | 1/1992 |
| EP | 0903138 A1 | 3/1999 |
| EP | 1038512 A1 | 9/2000 |
| GB | 2048661 | 12/1980 |
| WO | 9803142 A1 | 1/1998 |
| WO | 9915397 A1 | 4/1999 |

* cited by examiner

DRIVE SYSTEM FOR A HUMAN POWERED VEHICLE

The present invention relates to drive systems and transmission systems for human powered vehicles, and in particular, but not exclusively, for hand-operated vehicles such as wheelchairs. The present invention also relates to improvements to backrests for such vehicles.

Conventional wheelchairs, and the majority of high performance wheelchairs, are driven manually by a user by applying a load directly to the drive wheels, or to a handle attached thereto in the form of a rim. This provides excellent mobility for the user but the operating position can be uncomfortable and the speed which can be obtained is limited since the arrangement is designed for the generation of relatively large amounts of torque for good manoeuvrability, for example to ride over small bumps or depressions in the ground, or for fast changes of direction to avoid obstacles. The downside to conventional wheelchairs is that the user has to work extremely hard to cover larger distances requiring many applications of manual power to the wheels.

Another problem with the conventional wheelchair arrangement is that the user has to move the lower arm and wrist over the road wheels which can cause friction burns if contacted at speed and may snag clothing. Also, when using the wheelchair outdoors the wheels may transfer dirt and other contaminants from the road or paved surface directly onto the user or the user's clothing.

Solutions to these problems are known in the art which address the problem of altering the gearing on a wheelchair, and similar vehicles such as bicycles and tricycles, to make it better suited to propelling the user forward at greater speed more efficiently. However, most known systems are limited since the transmission systems employed are restricted to high speed mode and do not have a facility for selecting a low speed/high manoeuvrability mode. Also such systems do not allow wheelchairs to manoeuvre backwards, and therefore such transmission systems are not suitable for use over short distances where a high degree of manoeuvrability is required, particularly indoors, where users often need to move forwards and backwards to negotiate furniture.

One transmission system known in the art allows the user to operate the wheelchair selectively in high speed and high manoeuvrability modes. This system is described in U.S. Pat. No. 5,941,547 and includes use of an arrangement of levers for applying power to the transmission and a spring clutch mechanism for engaging and disengaging the transmission system. During each power stroke the springs grip drive wheel spindles to transfer power from the levers to the drive wheels. During the return stroke of the levers the springs disengage with the drive wheel spindles allowing the drive wheels to freewheel. The clutches only engage the drive wheel spindles during power strokes and the wheels can move independently of the clutches at all other times. This arrangement allows the user to use the levers to propel the wheelchair along in the forwards direction at high speeds and to propel the wheelchair via the wheel rims, as with a conventional wheelchair, when a high degree of manoeuvrability is required.

However, whilst this particular arrangement addresses the problems of selecting between gearing for either high speed or high manoeuvrability, the transmission offers poor performance. This is because the spring clutches provide poor application of power to the wheel spindles since there is a tendency for slippage between the springs and the drive wheel spindles. Also, the springs do not always release the spindles to provide the desired freewheel movement necessary for high manoeuvrability or disengage to allow a backward movement of the wheelchair.

Furthermore, the levers are connected by cables to pulleys which house the clutches. The cables have a tendency to bunch and/or stretch causing unequal application of power to each wheel. An additional problem of this type of wheelchair is that the lever system prevents easy mounting and dismounting from the chair.

Another problem with wheelchairs is that they either have fixed back rests or back rests that can be set in few predetermined positions. This can lead to severe discomfort for the user of the wheelchair if the position of the backrest cannot be adjusted to suit his/her requirements.

Accordingly the present invention seeks to provide a drive system for a human powered vehicle that mitigates at least some of the aforesaid problems and/or provides an alternative system.

According to one aspect of the present invention there is provided a drive system for a human powered vehicle including at least one input member, a transmission system arranged to convert movement of the input member to rotation of an output member, and a lock mechanism including at least one drive member for selectively locking a drive wheel to the output member for rotation therewith.

The drive member is arranged for movement from a first operational position in which the drive wheel is not locked to the output member to a second operational position in which the drive wheel is locked to the output member, and back to the first operational position, under the control of a user of the vehicle. The drive system allows the user to choose between propelling the vehicle using the drive system or disengaging the drive system from the drive wheel and propelling the vehicle by some other means, for example by wheel rims.

Advantageously the drive system can be arranged to drive the wheelchair forwards when the drive wheel is locked for rotation with the output member. When the drive wheel is not locked for rotation with the output member, the wheelchair can be driven either forwards or backwards by some other means, such as direct application of power to the drive wheel or a rim attached to the drive wheel.

Advantageously the at least one drive member is arranged to have a component of movement in the axial direction of at least one of the output member and the drive wheel. Preferably the at least one drive member is arranged to move substantially in the axial direction of at least one of the output member and the drive wheel.

Advantageously the lock mechanism includes biassing means for biassing the at least one drive member into a locked condition. Preferably the drive member is biassed into engagement by a resilient means such as a spring. Preferably the lock mechanism includes a plurality of drive members, fore example the drive system can include between one and four drive members, but may include between one and six, or one and ten drive members, or any practicable number.

Preferably the output member includes at least one formation arranged to engage with a complementary formation on the drive member, and may include a plurality of formations each arranged to receive the drive member, such as a plurality of apertures formed in the output member.

Preferably the or each drive member is located in a housing. Preferably the or each drive member is arranged for sliding movement within the housing. The drive member is arranged for sliding movement in a direction that is substantially parallel to the drive wheel axis and is arranged to extend out of the housing to connect the output member with the drive wheel. Drive is transmitted between the output member and the drive wheel via the or each drive member connecting them.

Advantageously the drive wheel includes a hub and the or each drive member is arranged to connect the output member to the hub, thereby locking the drive wheel for rotation with the output member.

Preferably the or each drive member is housed in the hub. The or each drive member is arranged to move between a first operational position in which it engages the output member and a second operational condition in which it does not engage the output member.

Preferably the lock mechanism includes manually operable actuator means for moving the at least one drive member between operational positions.

Preferably the manually operable actuator means is located on the drive wheel, for example on the hub. This is advantageous since it provides good access to the lock mechanism so that the user of the wheelchair can easily operate it. Preferably the actuator means includes an operating handle. The handle includes a cam surface, which is arranged such that movement of the handle causes the or each drive member to move into or out of engagement with the output member. Preferably the operating handle is arranged for pivoting movement.

Advantageously the transmission system includes a clutch mechanism arranged to drive the output member when a user drivingly actuates the at least one input member and to allow relative movement between the clutch mechanism and the output member when the at least one input member is not drivingly actuated. The drive wheel is thus driven when the input member is drivingly actuated and freewheels when the input member is not drivingly actuated. When the transmission is in use the wheelchair can only be propelled in the forwards direction. The transmission prevents the wheelchair from rolling backwards, hence the need for a lock mechanism for selectively coupling and decoupling the drive wheel to the output member. One consequence of this is that when going up hill, the wheelchair does not roll backwards after a power stroke. Preferably the input member includes means for limiting the extent of movement of the input member. Preferably the means for limiting the extent of movement of the input member includes a first formation for limiting movement of the input member in the direction of a power stroke. Preferably the means for limiting the extent of movement of the input member includes a second formation for limiting movement of the input member in the direction of a return stroke.

Preferably the clutch mechanism includes roller elements and is mounted on the output member co-axially therewith.

In a preferred embodiment the output member comprises an axle with a drive plate mounted thereon, wherein the drive plate is fixed for rotation with the axle.

Advantageously the at least one input member is arranged for reciprocating motion, and the drive system can include a plurality of input members. Preferably each input member is arranged to drive a single drive wheel so, for example, when a vehicle includes two input members there are two drive wheels and two transmission systems for transmitting power to the drive wheels. In most wheelchair applications the input member(s) will be hand operated, however on some wheelchairs and other types of human powered vehicles, the input member(s) can be arranged to be operated by foot. Preferably the at least one input member comprises a lever.

Advantageously the at least one input member can be arranged such that it can be rotated into a storage position without operating the transmission system. Preferably the storage position is substantially in line with or below the level of the seat of the wheelchair. Preferably the input member is located on the frame of the wheelchair and the position of the input member thereon is adjustable.

Advantageously the transmission system includes a first gearing element, such as a first pulley wheel, that is arranged to be driven by the input member and a second gearing element, such as a second pulley wheel, that is arranged to drive the output member. Preferably drive is transmitted between the first and second pulley wheels by a pulley belt and the second pulley wheel is arranged to transmit drive to the output member via the clutch mechanism. When the input member is drivingly actuated the pulley belt is wound onto the first pulley wheel, thereby causing the second pulley wheel and the output member to rotate. Advantageously the transmission includes a resilient means for biassing rotation of the second pulley wheel. The second pulley wheel is arranged to load the resilient means when the input member is drivingly actuated and the resilient means is arranged to load the second pulley wheel when the input member is not drivingly actuated, such that at the end of an input action the resilient means winds the pulley belt off the first pulley wheel, back onto the second pulley wheel, thereby biassing the input member to its start position. Preferably the resilient means is a spring and more preferably is a clock spring.

Advantageously the first and second pulley wheels are mounted on the frame of the wheelchair such that their positions are adjustable. This, together with the adjustability of the position of the input member, enables the transmission to be set up in accordance with the needs of a particular user.

Advantageously the drive system includes a braking system. Preferably the braking system includes a disc brake system with a disc mounted on the output member and at least one pair of callipers arranged to engage the disc brake when actuated by a user via a brake lever.

According to another aspect of the present invention there is provided a human powered vehicle including a drive system as described above. For example, the drive system can be used on a wheelchair, bicycle, tricycle or multi-wheeled vehicle.

Advantageously the vehicle includes at least one drive wheel including a quick release mechanism for attaching the drive wheel to the vehicle.

Advantageously the vehicle may include a continuously adjustable backrest. Preferably the backrest is continuously adjustable through an angle of approximately thirty degrees.

According to another aspect of the present invention there is provided a transmission system for a human powered vehicle including an input member, first and second gearing elements, a clutch and a flexible drive member for transmitting drive between the first and second gearing elements, wherein the input member is arranged to drive the first gearing element, the output member is arranged to be driven by the second gearing element via the clutch, and the clutch includes a plurality of roller elements arranged to drive the output member when the input member is drivingly actuated by a user and to allow the output member to rotate relative to the roller elements when the input member is not drivingly actuated.

Preferably the first and second gearing elements comprise first and second pulley wheels, and the flexible drive member comprises a pulley drive belt.

Advantageously, the transmission system may include features of the transmission system described above in relation to the drive system.

According to another aspect of the present invention there is provided a human powered vehicle including a frame and a backrest pivotally attached thereto and lock means for locking the angular position of the backrest relative to the frame, wherein the angle of the backrest relative to the frame is continuously adjustable through a range of values.

In a first embodiment the lock means includes a screw element arranged to control the orientation of the backrest. Preferably the screw element is attached to the backrest and is arranged to engage the frame to set the angle of the backrest relative to the frame. Preferably the frame includes a formation that is arranged to receive the screw element, such as a bracket with a slot formed therein. Preferably the screw element includes a lock element, such as a lock nut. The angle of the backrest is determined by the interaction of the screw element, lock element and the frame formation.

Advantageously the backrest can be adjusted through an angle of approximately 30 degrees.

Advantageously the screw element can be disengaged from the frame and the backrest can be folded substantially flat against the frame or seat.

In an alternative embodiment the lock means includes a lock member, such as a lock plate, to fix the orientation of the backrest. The lock member is pivotally attached to the backrest via a first pivot element and is pivotally attached to the frame by a second pivot element.

Advantageously the first pivot element is arranged to move translationally and rotationally relative to the lock member.

Preferably the lock member includes a first formation including a first part that provides a locking function, hereinafter referred to as the lock part, and a second part that enables a folding function, hereinafter referred to as the fold part, that is arranged to engage the first pivot element, wherein the first formation is arranged such that when the first pivot element engages the lock part the angular position of the backrest relative to the frame is fixed, and when the first pivot element engages the fold part the backrest can be folded into a storage position.

Preferably the first formation is substantially L-shaped. The lock part comprises a first leg of the L-shaped first formation and the fold part comprises a second leg of the L-shaped first formation. Preferably the second leg is longer than the first leg.

Preferably the first formation is a slot formed in the lock member and the first pivot element is arranged for sliding movement therein.

Advantageously the translational position of the second pivot element relative to the lock member is adjustable. Preferably the lock member includes a second formation arranged to engage the second pivot element, wherein the relative positions of the lock member and the frame determine the angular position of the backrest to the frame.

Preferably the second formation is a slot formed in the lock member and the second pivot element is arranged for sliding and rotational movement therein. Advantageously the lock means includes means for fixing the translational position of the second pivot element relative to the lock member, which allows the lock member to rotate about the second pivot element. This enables a user to select the angular position of the backrest and then fix the translational position of the lock member relative to the frame to ensure that when the backrest is moved between the storage and upright positions the backrest returns to substantially the same angular position each time.

Figure 1A:
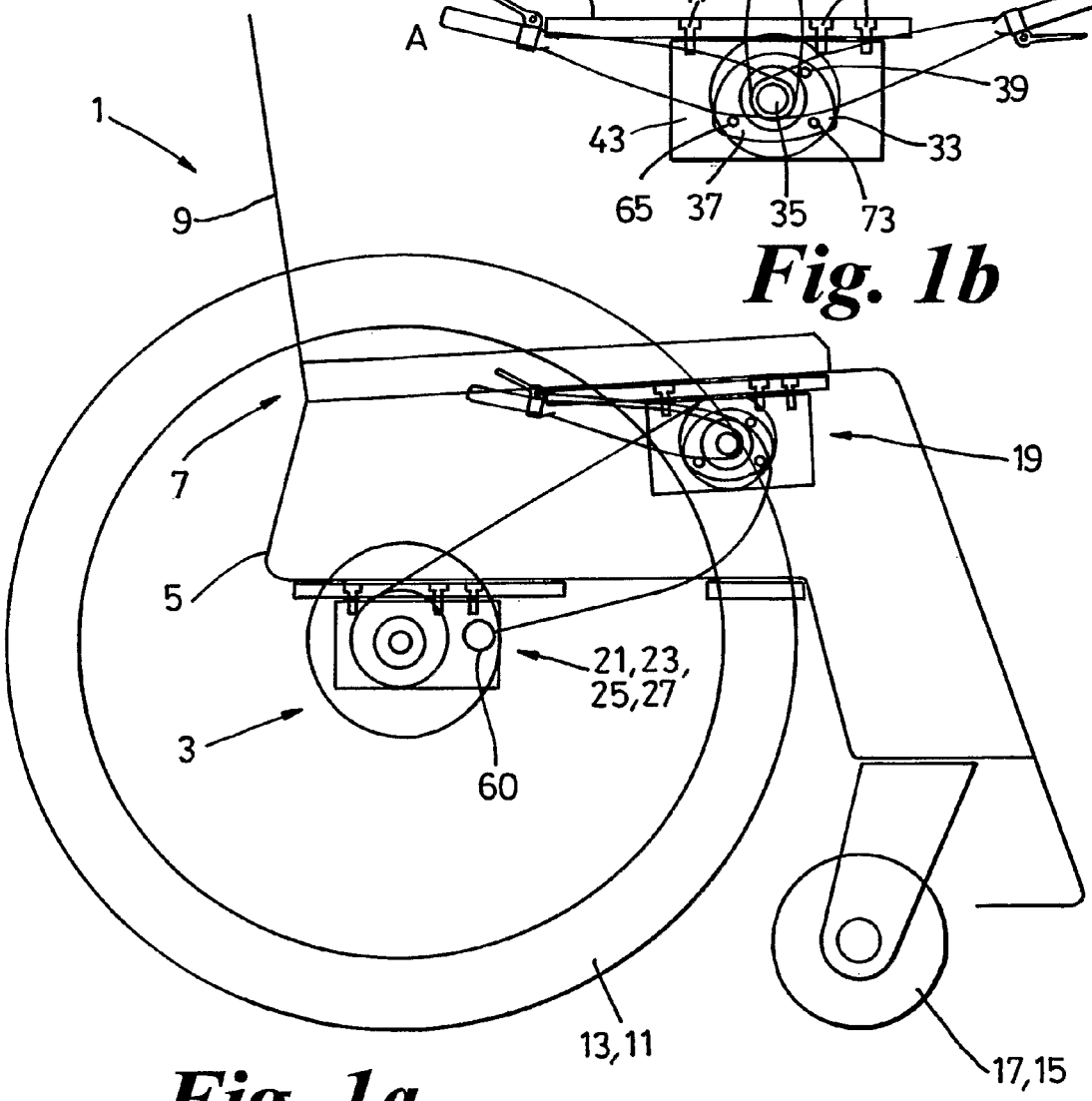

An embodiment of the present invention will now be described, by way of example only, with reference to the accompanying drawings in which like references indicate equivalent features, wherein:

FIG. 1*a* is a side view of a wheelchair including a drive system according to the invention;

FIG. 1*b* is a detail view of a drive assembly at a larger scale than shown in FIG. 1*a;*

Figure 1C:
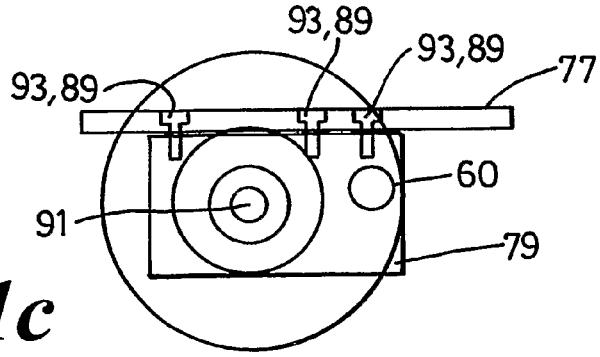

FIG. 1*c* is a detail view of a transmission assembly at a larger scale than shown in FIG. 1*a;*

Figure 2B:
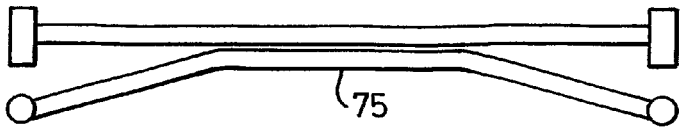
Figure 2A:
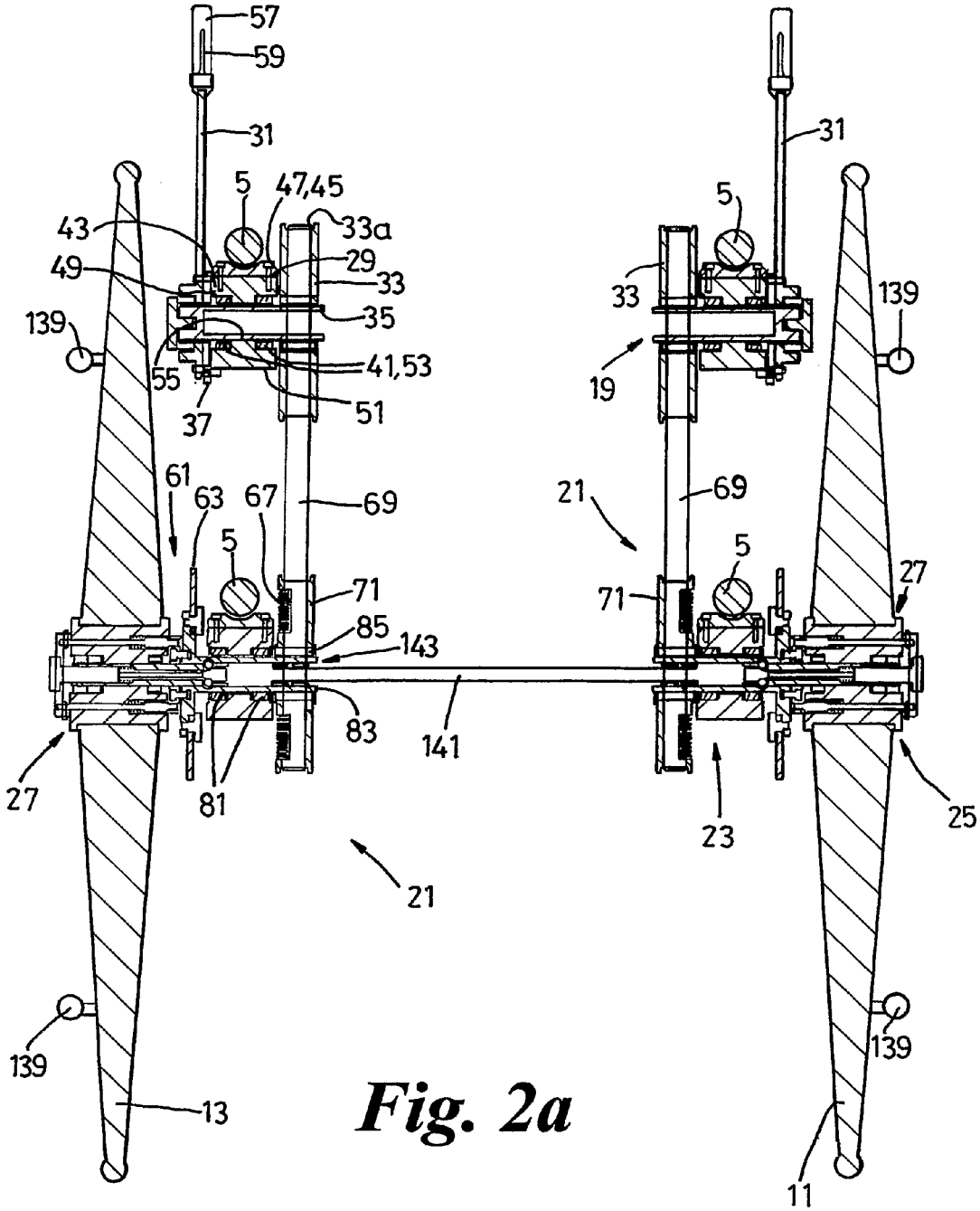
Figure 3A:
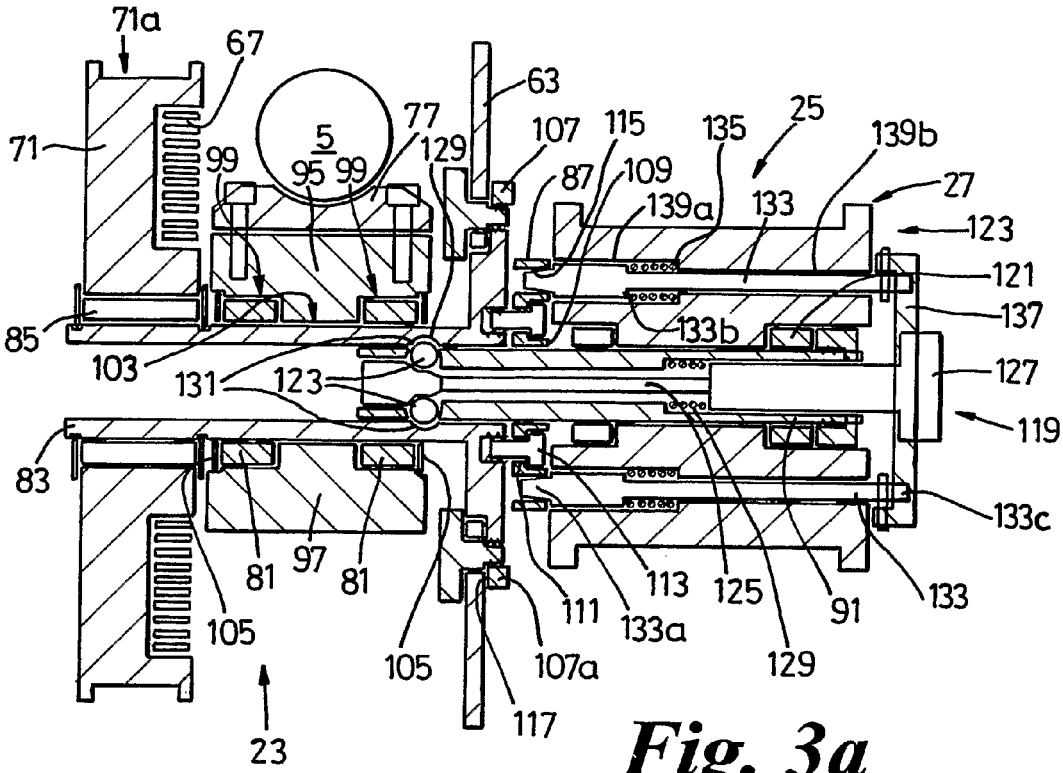

FIG. 2*a* is a front sectional view of a wheelchair having two drive systems mounted thereon;

FIG. 2*b* is a front view of a T-bar;

FIG. 3*a* is a front sectional view of a transmission assembly at a larger scale than shown in FIG. 2*a;*

Figure 3B:
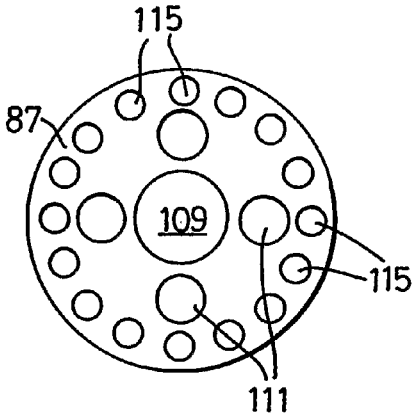

FIG. 3*b* is a plan view of a drive plate; and

Figure 3C:
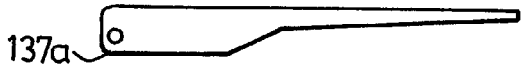
Figure 3D:
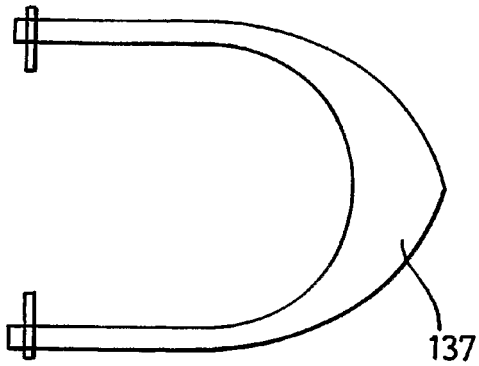
Figure 6:
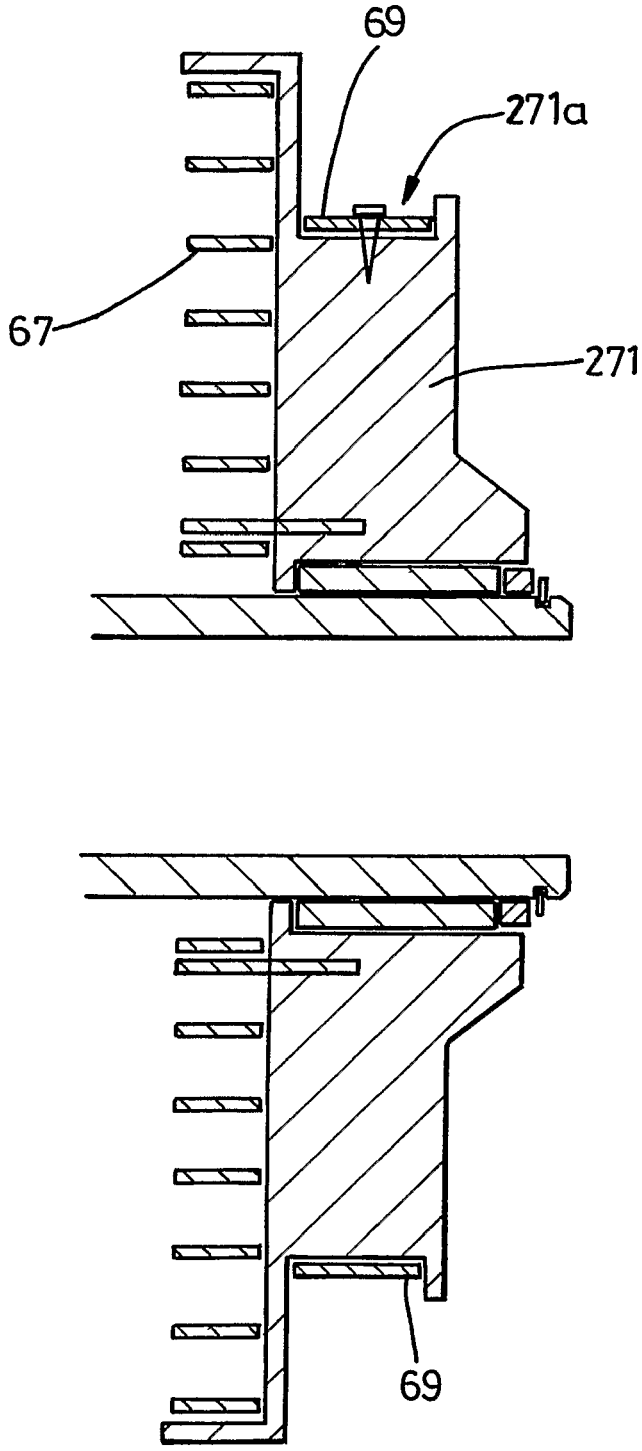
Figure 7A:
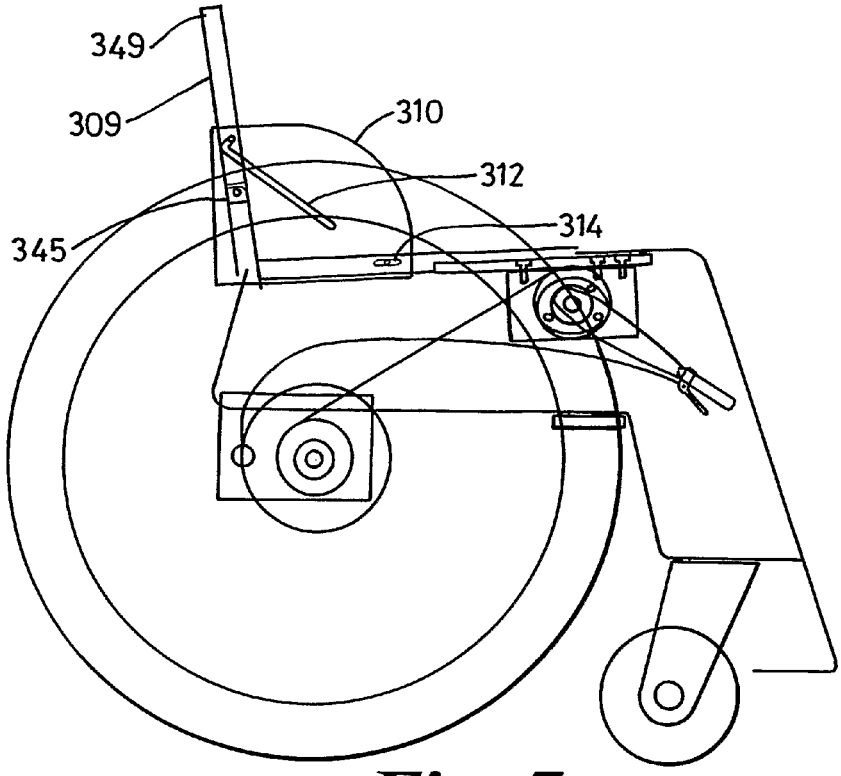
Figure 7C:
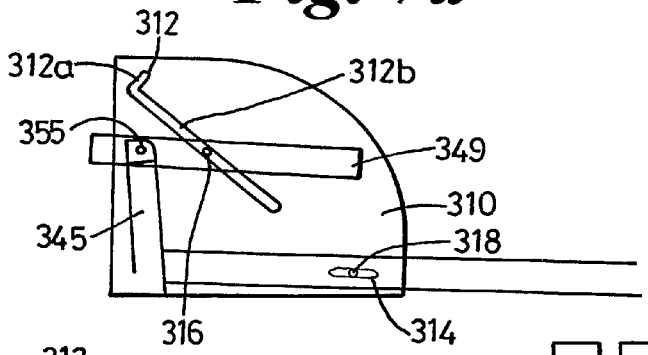
Figure 7B:
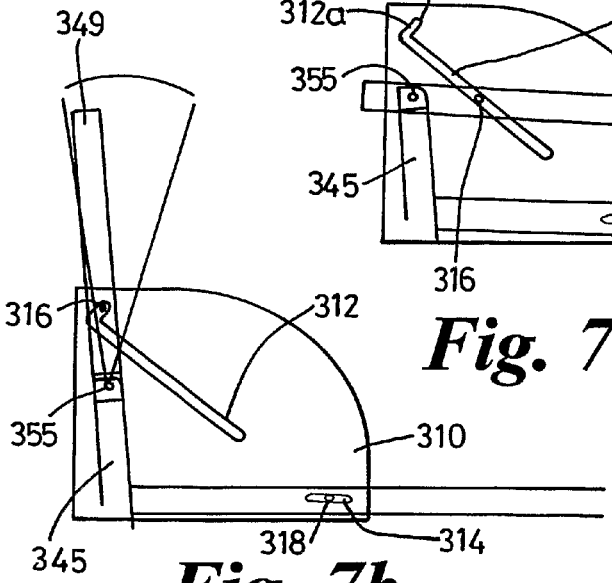
Figure 7D:
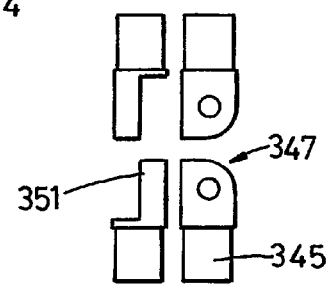

FIGS. 3*c* and 3*d* show side and plan views of a toggle handle;

FIGS. 4*a* to 4*f* show alternative arrangements for attaching the transmission assembly to the wheelchair;

FIGS. 5*a* to 5*d* are views of a first adjustable backrest;

FIG. 6 is a sectional view of an alternative arrangement of a pulley wheel; and FIGS. 7*a* to 7*d* are views of a second adjustable backrest.

FIG. 1*a* is a side view of the wheelchair 1 including a hand powered drive system 3 according to the current invention. The wheelchair 1 can be conventional or a high performance wheelchair, such as those used for racing or other sports. The wheelchair 1 includes a frame 5, a seat 7 including an adjustable backrest 9, left and right drive wheels 11,13 towards the rear of the chair and two castors 15,17 towards the front. The drive system 3 is arranged to drive the left and right drive wheels 11,13 independently of each other to provide maximum mobility for the user of the vehicle.

The drive system 3, for each drive wheel 11,13 includes a drive assembly 19 that is attached to the underside of a frame member and a transmission assembly 21 that includes a first sub-assembly 23 that is attached to the underside of the wheelchair frame below the seat 7 and a second sub-assembly 25 mounted in the hub 27 of the drive wheel.

The drive system 3 for the left drive wheel 11 is substantially identical to the drive system for the right drive wheel 13.

The drive assembly of the right drive wheel 13 will now be described with reference to FIGS. 1*a*, 1*b* and 2*a*. The drive assembly 3 includes a frame attachment plate 29, a lever 31, a first pulley wheel 33, a shaft 35 having a flange 37 with a first lug 39 mounted thereon, a pair of bearings 41 to support the shaft and a housing 43 to support the bearings.

The frame attachment plate 29 is attached to the underside of the frame member. Preferably the frame attachment plate 29 is welded to the wheelchair frame 5 but it may alternatively be bolted thereto. Sixteen holes 45 are formed through the plate and are arranged in two parallel lines of eight holes. The attachment plate 29 is typically made from aluminium, but may be made from steel or a plastics material.

The housing 43 depends vertically from the frame attachment plate. The housing 43 is attached to the plate by six bolts 47. The bolts 47 pass through six of the holes in the attachment plate 29. The position of the housing 43 relative to the plate 29, and hence the wheelchair frame 5, can be adjusted by unbolting the housing 43, relocating the housing 43 and rebolting to the plate. The housing 43 is typically made from aluminium but can be made from steel or a plastics material. The housing 43 comprises two parts: an upper and a lower part 49,51 and includes two recesses 53 to accommodate the bearings 41. The housing also includes a horizontal aperture 55 having a circular cross section that connects the recesses 53 to accommodate the shaft 35. Preferably the bearings are ball bearings and are arranged to support the shaft 35 and accommodate rotational motion of the shaft.

The shaft 35 is located in the horizontal aperture 55 in the housing and is supported by the bearings 41. Fixedly attached to one end of the shaft is a first pulley wheel 33 having a profiled surface 33*a*. Pivotally attached to the other end of the shaft is a lever 31. Juxtaposed with the lever 31, and fixedly attached to the shaft 35, is the flange 37.

The flange 37 is perpendicular to the axis of the shaft. In plan, the flange 37 is substantially semi-circular. The base of the flange extends beyond the shaft 35 and is convex. The first lug 39 protrudes perpendicularly from the flange towards the lever 31, extending a distance such that the lever 31 can engage therewith.

The lever 31 is substantially rigid and is preferably made from steel. The lever typically has a length in the range of 250-350 mm. At one end of the lever there is a hand grip 57 and a brake lever 59. The brake lever 59 is connected by a cable to callipers 60 located in the transmission assembly 21 and is used to actuate the wheelchair braking mechanism 61. The callipers 60 are arranged to grip a brake disc 63 when the user squeezes the brake lever 59 to arrest motion of the wheelchair 1.

The lever 31 is pivotally attached to the shaft 35 at the opposite end to the hand grip 57. The lever 31 can be rotated relative to the shaft 35 in a vertical plane through an angle of approximately 150 degrees. The lever 31 has a rest position A that is approximately 15 degrees from the horizontal when pivoted towards the wheelchair backrest 9 (see FIGS. 1*a* and *b*). A second lug 65 protrudes from the side of the flange 37 and acts as a stop, or rest, for the lever, thus defining the rest position A. When the lever 31 is in the rest position A the user is able to exit the wheelchair 1 in a similar fashion to a conventional wheelchair.

The lever can be pivoted away from the backrest 9 (clockwise in FIG. 1*b*) from the rest position A into the drive start position B which is substantially vertical. The lever converts the wheelchair user's pushing force into rotational motion of the shaft 35, and hence of the first pulley wheel 33. The power stroke of the lever 31 is through approximately 90 degrees, in a clockwise direction, i.e. away from the user. In the return stroke the lever 31 rotates through 90 degrees anticlockwise, i.e. towards the user, under the biassing action of a clock spring 67 in the transmission 21 and returns to the vertical position ready for the next power stroke.

The first pulley wheel 33 has a diameter of 100 mm and has a profiled surface 33*a* that is arranged to receive a drive belt 69. Preferably the drive belt 69 is a flat drive belt made from rubber or a rubber compound material and has a width in the range 20-25 mm and a thickness in the range 1-2 mm. Optionally, the drive belt can be reinforced for example with fabric. A section of the drive belt is anchored to the first pulley wheel, for example by cementing or using double-sided adhesive tape, towards one end of the arcuate surface 33*a*. The belt 67 runs from the anchor point along the arcuate surface 33*a* and is connected at its other end to a second pulley wheel 71 in the transmission assembly 21. A third lug 73 protrudes from the side of the flange 37 and acts to restrict rotational movement of the first pulley wheel 33 in the belt unwind direction. The third lug 73 can be positioned to engage the first pulley wheel 33 directly or to engage the flange 37.

The lever 31 can rotate freely relative to the shaft 35. When the lever 31 is rotated clockwise from the rest position A to a substantially vertical position B (drive start position), the lever 31 abuts the first lug 39 which is fixedly attached to the flange 37. Further rotation of the lever 31 in the clockwise direction from the vertical position (a power stroke) drives the first lug 39, flange 37, shaft 35 and first pulley wheel 33 to rotate in the clockwise direction since the flange 37 and the first pulley wheel 33 are fixedly attached to the shaft 35. When the first pulley wheel 33 rotates in the clockwise direction the drive belt 69 is wound onto the first pulley wheel 33 against the biassing action of the clock spring 67 in the transmission assembly 21.

During the return stroke, the clock spring 67 acts to unwind the drive belt 69 from the first pulley wheel 33, driving the first pulley wheel 33, shaft 35, flange 37, first lug 39 and lever 31 in an anticlockwise direction, until the flange 37 engages the third lug 73. When the flange 37 abuts the third lug 73, rotation of the first pulley wheel 33, shaft 35, flange 37, first lug 39 and lever 31 in the anticlockwise direction is arrested, with the lever 31 returned to the drive start position B.

The lever 31 can be returned to its rest position A by rotating the lever 31 about the shaft 35 in an anticlockwise direction from the drive start position B.

Optionally, the wheelchair 1 can include a bar which is attached to the levers of the left and right drive assemblies (see FIG. 2*b*). This allows a user to operate both levers substantially simultaneously whilst pushing on the bar 75. Steering is achieved by adjusting the point along the bar at which the user pushes the bar to control the amount of force applied to each of the levers.

The transmission assembly 21 for the right drive wheel will now be described with reference to FIGS. 1*a*, 1*c*, 2*a*, 3*a* to 3*d* and 4*a* to 4*f*. The transmission assembly 21 includes a first sub-assembly 23 mounted on the wheelchair frame 5 that includes a frame attachment plate 77, a housing 79 depending from the attachment plate that supports a pair of bearings 81, a sleeve 83 mounted in the bearings 81, a one way clutch 85 mounted about the sleeve 83, the second pulley wheel 71 is mounted about the one way clutch 85 and houses the clock spring 67 therein, the disc brake system 61 and a drive plate 87.

The frame attachment plate 77 is attached to the wheelchair frame 5 below the level of the seat 7 and is similar to the drive assembly attachment plate 29. Preferably the frame attachment plate 77 is welded to the wheelchair frame but may alternatively be bolted thereto.

Figure 4A:
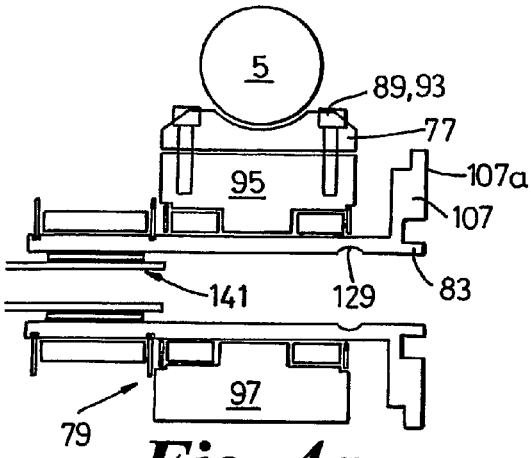
Figure 4E:
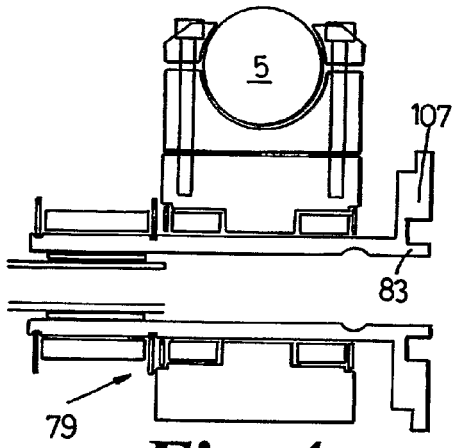
Figure 4B:
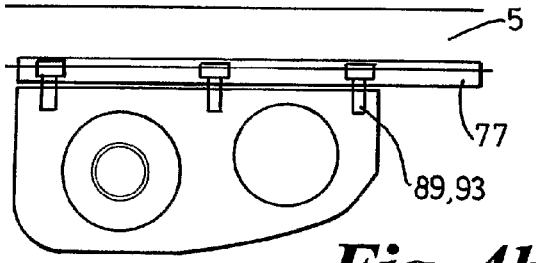
Figure 4F:
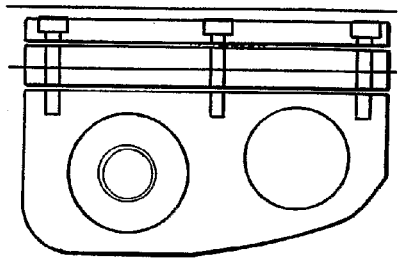
Figure 4C:
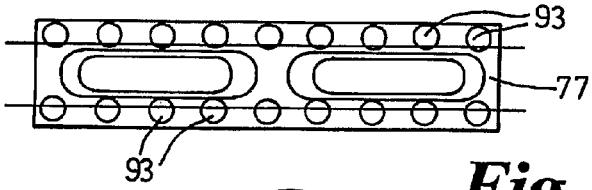
Figure 4D:
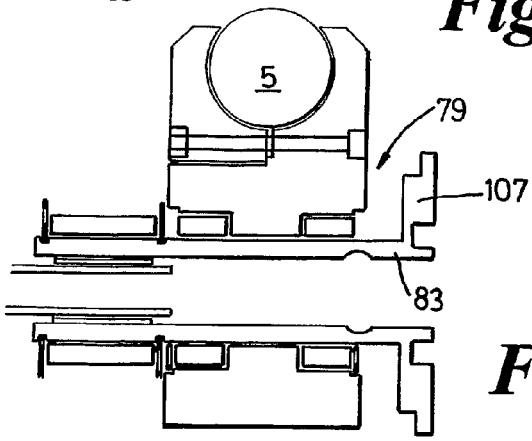

The housing 79 depends vertically from the frame attachment plate 77 (see FIGS. 4*a* to 4*c*). The housing 79 is attached to the plate by six bolts 89. The bolts 89 pass through six of the holes 93 in the attachment plate. Alternative ways of attaching the housing to the frame are shown in FIGS. 4*d*, 4*e*; and 4*f*.

The position of the housing relative to the plate 77, and hence the wheelchair frame 5, can be adjusted by unbolting the housing 79, relocating the housing and re-bolting to the plate 77. The position of the transmission assembly 21 is influenced by the needs of the user operating the wheelchair and the balance required. The housing 79 is typically made from aluminium but can be made from steel or a plastics material. The housing 79 comprises two parts: an upper and a lower part 95,97 and includes two recesses 99 to accommodate the bearings 81. The housing 79 also includes a horizontal aperture 103 having a circular cross section that connects the recesses 99 to accommodate the sleeve 83. Preferably the bearings 81 are ball bearings and are arranged to support the sleeve 83 and accommodate rotational motion of the sleeve 83.

The second pulley wheel 71 includes a circumferential groove 71*a* in its outer surface that is arranged to receive the drive belt 69, which preferably has a diameter of 100 mm. Since the first pulley wheel 33*a* and the drive belt groove 71*a* in the second pulley wheel both have a diameter of 100 mm the gearing of the drive system is approximately 1:1. For different gearing arrangements different sized first and second pulley wheels 33, 71 can be used or higher/lower gears can be incorporated within the housing 43 that are arranged for actuation by the levers.

The drive belt 69 is attached to the second pulley wheel 71, preferably by double-sided adhesive tape or cementing, and is wound several times around the diameter of the pulley wheel within the groove 71*a*. When the lever 31 is used to drive the wheelchair 1 tension in the drive belt 69 causes the second pulley wheel 71 to rotate and the belt 69 to unwind from the second pulley wheel 71 (clockwise direction in FIG. 1*a*).

The second pulley wheel 71 includes an annular groove 71*b* in one side having an inner diameter of 50 mm and an outer diameter of 80 mm. The groove is arranged to accommodate the clock spring 67. The clock spring 67 has one end attached to the second pulley wheel 71 and the other end attached to the housing 79. The clock spring 67 biasses the second pulley wheel 71 against rotation in the unwind direction, i.e. it biases the pulley wheel anticlockwise in FIG. 4*b*.

The sleeve 83 is located in the horizontal aperture 103 in the housing and is supported by the bearings 81 and retained by a pair of circlips 105. The one way clutch 85 is mounted about one end of the sleeve 83. The second pulley wheel 71 is mounted on the one way clutch 85. The one way clutch 85 includes a plurality of roller elements (not shown) that engage the sleeve 83 when the second pulley wheel 71 is rotated in a first direction and do not engage the sleeve 83 when rotated in a second direction. The arrangement is such that the sleeve 83 is locked for rotation with the second pulley wheel 71 when the second pulley wheel 71 is drivingly rotated by operation of the lever 31 (rotating clockwise in FIG. 1*a*) and rotates relative to the second pulley wheel 71 when the pulley wheel rewinds under the action of the clock spring 67 after the power stroke has been completed and the lever 31 is returning to the start position B. Thus the one way clutch 85 drivingly engages the sleeve 83 during the power stroke and at the end of the power stroke the sleeve 83 continues to rotate in the same direction whilst the second pulley wheel 71 begins to rotate in the opposite direction under the action of the clock spring 67. Hence the wheelchair 1 freewheels when the lever 31 is returning to its start position B.

At the other end, the sleeve 83 has a flange 107. The flange 107 has an end face 107*a* and the drive plate 87 is attached to the end face 107*a* of the flange co-axially with the sleeve 83. The drive plate 87 comprises a central aperture 109 having a diameter equal to the inner diameter of the sleeve, four holes 111 arranged to receive bolts 113 to secure the plate 87 to the flange 107 and sixteen holes 115 uniformly distributed about the circumference of the plate. The drive plate 87 is fixed to the flange 107 such that it is locked for rotation with the sleeve 83.

The flange 107 also has an annular recess 117 in which is mounted the disc brake 63. Callipers 60 mounted about the disc brake 63 can act on the brake to slow down the wheelchair 1.

The transmission assembly 21 includes a second sub-assembly 25 that engages with the first sub-assembly 23 to transmit power from the drive assembly 19 to the drive wheel 13. The second sub-assembly 25 is mounted in the wheel hub 27 of the drive wheel 13 and includes the spindle 91, a quick release mechanism 119 for attaching the spindle 91 to the sleeve 83 in the first sub-assembly, a pair of bearings 121, and a lock mechanism 123 for selectively locking rotation of the drive wheel 13 to rotation of the sleeve 83.

The spindle 91 is mounted in the pair of bearings 121 such that the drive wheel 13 can rotate about the spindle 91. The spindle 91 extends out of the hub 27 through the drive plate 87 and into the sleeve 83. The quick release mechanism 119 comprises two steel balls 123, a shaft 125 mounted within the spindle that is arranged to control the radial positions of the balls 125, a manually operable button 127 attached to the shaft and a return spring 129 for returning the button 123 to a start position when pressure has been removed from the button.

When the drive wheel 13 is not attached to the wheelchair 1 the steel balls 125 protrude through apertures 131 formed in the spindle. The balls 125 are held in place by the resilient action of the return spring 129. When the drive wheel 13 is attached to the wheelchair the spindle 91 is located within the sleeve 83 and pushed into place. The sleeve 83 forces the steel balls 125 to retract within the spindle 91 thereby compressing the return spring 129 until the spindle 91 reaches a circumferential recess 129 within the inner surface of sleeve wherein the resiliency of the return spring 129 forces the balls 125 into the recess and thereby locks the longitudinal position of the spindle 91 relative to the sleeve 83.

The spindle 91 is released by depressing the button 127 so that the balls 125 can retract within the spindle, and the spindle can be removed from the sleeve 83.

The lock mechanism 123 includes first and second drive pins 133, first and second drive pin springs 135, and a toggle handle 137. Each drive pin 133 is arranged parallel to the spindle 91 and is arranged for sliding movement within a bore 139 extending through the hub 27. Each bore 139 is arranged parallel to the axis of the hub and has first and second parts 139*a*,139*b*, wherein the first part 139*a* has a larger diameter than the second part 139*b* thereby defining a shoulder at the juncture. The hub 27 is arranged such that the first parts 139*a* of the bores are adjacent the drive plate 87 when the drive wheel 13 is attached to the wheelchair.

Each drive pin 133 is elongate, has a tapered leading end 133*a* arranged for engaging the holes 115 in the drive plate and a shoulder 133*b* on which a drive pin spring 135 can act. The drive pin springs 135 are mounted in the first parts 139*a* of the bores and are arranged to bias their respective drive pins 133 into engagement with the drive plate 87. The toggle handle 137 is pivotally connected to the trailing ends 133*c* of the first and second drive pins. The toggle handle 137 includes a cam surface 137*a* for actuating the drive pins 133 and moving them from a first operational position in which they are engaged with the drive plate 87 (see FIG. 3*c*) to a second operational position wherein they are disengaged from the drive plate 87. When the drive pins 133 engage the drive plate the toggle handle 137 does not load the drive pins. When the toggle handle 137 is actuated, it applies a load to the drive pins 133 that overcomes the bias of the springs 135 towards the drive plate 87 and hence the drive pins 133 slide out of engagement with the drive plate and compress the drive pin springs 135. The drive wheel 13 is thus disengaged from the drive system and can freewheel about the spindle 91.

When the toggle handle 137 is returned to its original position the resiliency of the drive pin springs 135 biases the pins 133 back into engagement with the drive plate 87 thereby locking rotation of the drive wheel 13 to the drive plate 87. In this operational condition, actuation of the lever 31 system applies torque to the drive wheel 13 and the wheelchair 1 can be driven forwards.

This ability to lock and unlock rotation of the drive wheels 11,13 to the drive system 3 is particularly useful for the user of the wheelchair 1 since the drive system 3 is for forward motion over long distances and the wheelchair 1 is unable to move backwards when the drive system 3 is engaged. By simply rotating the toggle handle 137 through 180 degrees, the user is able to disengage the drive system 3 and can then drive the wheelchair using wheel rims 139 in the conventional manner. Thus the invention provides the fall manoeuvrability of a conventional wheelchair and with the advantage of high speed forward motion using the drive system 3.

Optionally, an axle tube 141 can be used to connect the right transmission assembly 21 to the left transmission assembly 21. The axle tube 141 can be mounted in each sleeve 83 in bearings 143 and can rotate relative to the sleeves 83. The axle tube 141 is inclined to accommodate any camber between the drive wheels 11,13, or alternatively the axle tube 141 can be straight between the drive wheels 11, 13 with cambered holes in housing 79. The axle tube 141 is used to support the left and right transmission assemblies 21 and assists to correctly position the transmission assemblies 21 on the wheel chair frame 5 for balance at the drive wheel, and at the levers 31, for people with shorter or longer arms. The axle tube 141 is used to support the left and right transmission assemblies 21 and assists to correctly position the transmission assemblies 21 on the wheelchair frame 5 for balance at the drive wheels, and at the levers 31, for people with long or short arms.

For the purpose of clarity, the operation of the drive system will now be described with reference to a single lever.

The user engages the drive system 3 by actuating the toggle handle 137 to move the drive pins 133 into engagement with the drive plate 87. The user from a sitting position in the wheelchair 1 rotates the lever 31 clockwise about the shaft 35 from the rest position A through approximately 90 degrees to the drive position B, wherein the lever 31 abuts the first lug 39. The user then holds the lever 31 using the handle grip 57*a* and pushes the lever 31 away from him/herself, forcing the lever to rotate clockwise (see FIG. 1*a*). This arrangement is advantageous since the user in reaction to pushing the levers 31 is pushed into the chair and can thus use the backrest 9 to support the upper body during the power stroke. The user rotates each lever 31 substantially simultaneously through 90 degrees to complete the power stroke.

As the lever 31 is rotated through the power stroke the lever pushes against the first lug 39 causing the flange 37, the shaft 35 and hence the first pulley wheel 33 to rotate clockwise. As the first pulley wheel 33 rotates clockwise it winds the drive belt 69 onto the first pulley wheel 33 causing the second pulley wheel 71, the one way clutch 85, sleeve 83, disc brake 63 and drive plate 87 to rotate clockwise as a unit against the bias of the clock spring 67. Since the drive pins 133 are engaged with the drive plate 87, the drive wheel 13 is locked for rotation with the sleeve 83, and thus torque is transmitted to the drive wheel 13 via the hub 27 causing the drive wheel 13 to rotate.

When the user has completed the power stroke the user relaxes his/her arms, or lets go of the lever 31. This allows the clock spring 67 to rotate the second pulley wheel 71 in the direction of winding the drive belt onto the second pulley wheel 71 (anticlockwise) and the first pulley wheel 33 rotates in the direction of winding the drive belt off the first pulley wheel 33 (anticlockwise) until the first pulley wheel abuts the third lug 73. This causes the shaft 35 to rotate anticlockwise and hence the flange 37 and the lever 31 to return to the drive start position B.

As the second pulley wheel 71 rotates anticlockwise the one way clutch 85 does not engage the sleeve 83, thus the sleeve 83 continues to rotate in the clockwise direction in a freewheel manner.

Since each drive wheel 13 is operated independently of the other, in practice it is necessary for the user to repeatedly operate both levers 31 substantially simultaneously in order to propel the wheelchair 1 forwards in a straight line. Steering is achieved by non-uniform operation of the levers 31, and operation of the brakes. For example, operating one brake lever 59 and the opposite lever 31 enables a very tight turn to be made.

In order for the user to arrest the motion of the wheelchair, the user pulls on the brake lever 59 which causes the calliper to engage the disc brake 63. The friction between the calliper and the disc brake 63 generates a braking force to the sleeve 83 which is transmitted to the drive wheel 13 via the drive pins 133.

In order for the user to perform a reverse manoeuvre, for example to move away from a desk or table, the toggle handle 137 is actuated to move the drive pins 133 out of engagement with the drive plate 87 thereby disengaging the drive system 3 from the drive wheel 13. The user can then operate the wheelchair 1 using the rims attached to the wheels in the conventional manner.

The wheelchair may also include a continuously adjustable backrest 9 that is attached to the frames (see FIGS. 5*a* to 5*d*). The frames includes a pair of support stems 145 extending substantially upright from the frame, with each support stem 145 having a through slot 147 formed in its end. The backrest comprises a substantially "⊓" shaped tubular member 149 that has a curved upper bar that is shaped to more comfortably accommodate the user. The backrest includes tongues 151 at each end that are arranged to fit into the slots 147 formed in the stems. Each tongue 151 has a first slot 153 extending through its thickness. The backrest is pivotally attached to each stem, and hence the frame, by a hinge 155 that extends diametrically across the stem 145 and through the first slot 153 formed in the tongue.

Each tongue 151 has a channel 157 formed into the end of the tongue, thus defining a pair of walls 159. Holes 161 are formed in each wall and a cross bar 163 is located in the holes 161 that is arranged to rotate therein. The cross-bar 163 has a threaded hole 165 extending through its body that is arranged to receive a screw element 167. The screw element 167 is elongate and has a knob 169 attached at one end and a nut 171 adjacent the knob. The screw element 167 is screwed into the threaded hole 165 and its position within the threaded hole can be adjusted by turning the knob 169. The screw element 167 is able to pivot relative to the backrest 9 by rotating the cross-bar 163.

Each stem 145 has a bracket 173 attached to it. Each bracket 173 has a substantially upright member 173*a* with a second slot 175 cut into it.

To lock the backrest 9 in an upright position, the backrest is rotated into position and the screw element 167 is located in the second slot 175 within the bracket. To finely adjust the angle of the backrest the position of the screw element 167 is adjusted within the threaded hole 165 by turning the knob 169. The angle of the backrest 9 can be adjusted through an angle of approximately thirty degrees. Since the angle of the backrest 9 is determined by the position of the screw element 167 in the threaded hole 165, the method provides a continuously adjustable backrest.

If a larger range of angular adjustment is required the components can be modified accordingly.

Figure 5A:
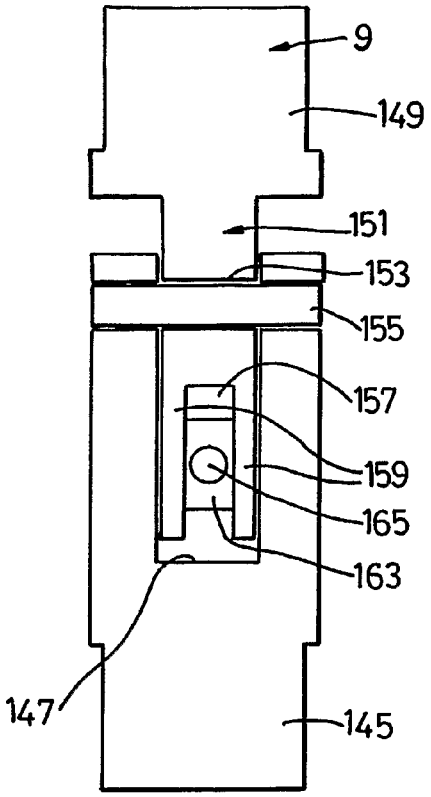
Figure 5B:
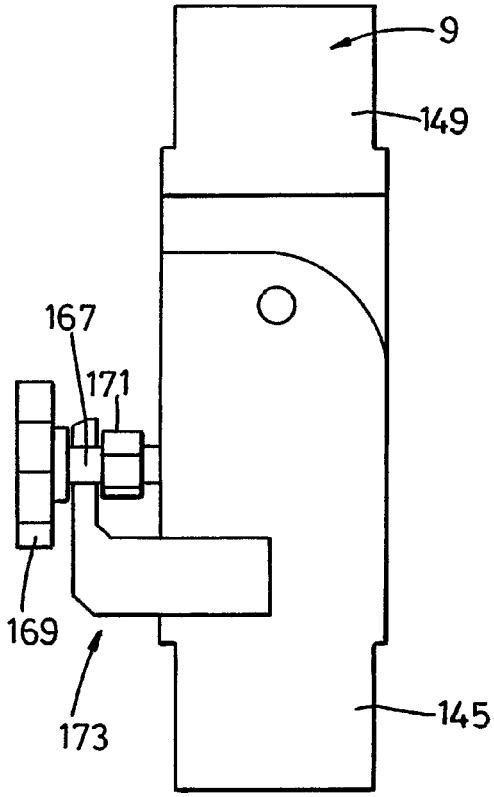
Figure 5C:
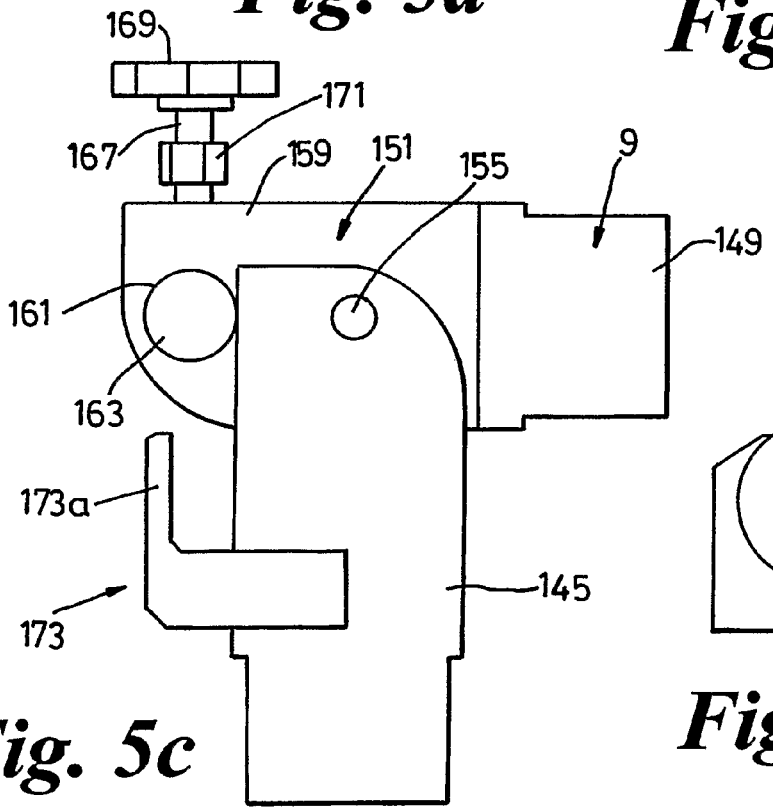
Figure 5D:
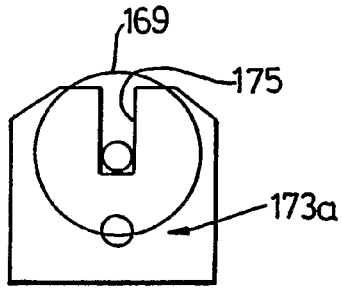

The backrest 9 can be folded flat by removing the screw element 167 from the second slot 175 and then lifting the backrest clear of the stems 145 and pivoting about the hinges 155 (see FIG. 5*c*).

It will be appreciated that alterations can be made to the embodiment described above without departing from the scope of the present invention. For example, the drive system gearing can be altered by changing the diameters of the first and/or second pulley wheels or incorporation of higher and lower gears within the housing, or the length of lever can be altered and also the size of the power stroke.

Methods of converting human effort to rotation of the sleeve other than a lever input system can be used, for example other types of reciprocating input members. The input members can be adapted to be operated by foot rather than by hand.

The number of drive pins for engaging the drive plate can be varied. The mechanism must include at least one drive pin, preferably two, but may use any practicable number, for example between one and ten drive pins. The retractable drive pins could be mounted on the sleeve and the drive plate mounted on the hub. Alternatively, the retractable drive pins could be mounted in a housing between the drive plate and hub and could be arranged such that drive pins engage both the hub and the drive plate.

Rather than using a manually operable toggle to move the drive pins in and out of engagement with the drive plate, this can be done using a suitable control system.

The drive system can be applied to other types of human powered vehicle for example tricycles or other multi-wheeled vehicles, including those for able bodied persons.

An alternative design of the second pulley wheel 71 can be used. For example, the alternative second pulley wheel 271 (see FIG. 6) is similar to the second pulley wheel 71 except that its body is arranged such that the clock spring 67 is not aligned with the circumferential groove 271*a* that receives the drive belt 69. This is advantageous since it enables a series of pulley wheels to be made that have bodies including a standard sized cavity to receive the clock spring 67 but which have different groove 271*a* circumferences to provide different gear ratios. A user can swap the pulley wheels 271*a* to select the desired gear ratio.

The transmission system can be arranged such that the full power stroke is achieved by moving the drive levers through an angle of between 50 and 80 degrees.

The levers can be arranged such that they fold forward when not used.

A second embodiment of a continuously adjustable backrest 309 is shown in FIGS. 7*a* to 7*d*. This arrangement can be used as an alternative to the arrangement shown in FIGS. 5*a* to 5*d*.

The backrest 309 is pivotally attached to the wheelchair frame. The frames includes a pair of support stems 345 extending substantially upright from the frame, with each support stem 345 having a through slot 347 formed in its end. The backrest comprises a substantially "⊓" shaped tubular member 349 that has a curved upper bar that is shaped to more comfortably accommodate the user. The backrest 309 includes tongues 351 at each end that are arranged to fit into the slots 347 formed in the stems. The backrest 309 is pivotally attached to each stem 345, and hence the frame, by a hinge 355 that extends across the stem 345. The backrest 309 includes a stop 352 to limit the amount of angular adjustment.

The backrest 309 includes first and second lock members 310 for locking the position of the backrest 309 and for enabling continuous adjustment of the angle of the backrest relative to the wheelchair seat through a predetermined angle, for example ±10 degrees. Each lock member 310 comprises a plate like member that includes an L-shaped slot 312 and a rectilinear slot 314. Each lock member 310 is pivotally attached to the "⊓" shaped tubular member 349 of the backrest via a first pivot pin 316 that is located in the L-shaped slot 312. Each lock member 310 is pivotally attached to the wheelchair frame via a second pivot pin 318 located in the rectilinear slot 314. Preferably the first pivot pin 316 comprises a screw element. A nylon washer is located between the screw elements head and the lock member. Preferably the second pivot pin 318 comprises a screw element and there is provided a star washer between the screw element head and the lock member.

The L-shaped slot 312 comprises a first part 312*a* that provides a locking function, hereinafter referred to as the lock part 312*a*, and a second part 312*b* that provides a folding function, hereinafter referred to as the fold part 312*b*. The lock part 312*a* is arranged at approximately 90 degrees to the fold part 312*b*. The L-shaped slot 312 is oriented in the lock member 310 such that the fold part slopes downwards at an angle within the range of around 20 to 60 degrees from the horizontal, and preferably around 45 degrees. The length of the fold part 312*b* is arranged to enable the backrest 309 to fold substantially flat against the seat of the wheelchair. The rectilinear slot 314 is preferably arranged substantially horizontally or in line with the wheelchair frame. The translational position of each lock member 310 relative to the frame of the wheelchair is adjustable. The interaction of the second pivot pin 318 and the rectilinear slot 314 limits the amount of translational movement allowable. Preferably the rectilinear slot 314 is positioned such that the fold part 312*b* of the L-shaped slot, if extended, would bisect it.

To lock the backrest 309 in position the lock member 310 is pivoted about the second pivot pin 318 to locate the first pivot pin 316 into the lock part 312*a* of the L-shaped slot 312. The resistance of the lock member 310 prevents the tubular member 349 from pivoting relative to the wheelchair frame about the hinge 355.

To unlock the backrest 309, the lock member 310 is pivoted to locate the first pivot pin 316 in the fold part 312*b* of the L-shaped slot. The tubular member 349 can then rotate relative to the wheelchair frame about the hinge 355. This enables the backrest 309 to be folded over the wheelchair seat. As the backrest 309 is folded, the first pivot pin 316 slides along the fold part 312*b* of the L-shaped slot. To relock the backrest 309, the backrest 309 is rotated back into the substantially upright position as far as the lock member 310 will allow, and then the lock member 310 is pivoted about the second pivot pin 316 to locate the first pivot pin 316 in the lock part 312*a* of the L-shaped slot.

Adjusting the angle of the backrest 309 relative to the seat of the wheelchair is achieved by adjusting the translational position of the lock member 310 relative to the frame of the wheelchair, and hence moving the position of the second pivot pin 318 within the rectilinear slot 314. For example, this can be achieved by loosening the screw element with a suitable tool, adjusting the position of the second pivot pin 316 by moving the lock member 310 forwards or rearwards and tightening the screw element again. If the lock member 310 is moved forwards this will cause the angle between the backrest 309 and the wheelchair seat to decrease and if moved backwards will cause the angle to increase. The user can select the angle of the backrest that is most comfortable.

When the angle has been set, each time the user moves the backrest from the storage position to the upright position it will return to substantially the same position.

The invention claimed is:

1. A drive system for a human powered vehicle including at least one input member, a transmission system arranged to convert movement of the input member to rotation of an output member, and a lock mechanism including at least one drive member for selectively locking a drive wheel to the output member for rotation therewith, wherein the lock mechanism includes manually operable actuator means for moving the at least one drive member between operational positions, and wherein the actuator means includes an operating handle having a cam surface, the arrangement being such that movement of the operating handle moves the at least one drive member into or out of engagement with the output member.

2. A drive system according to claim 1, wherein the at least one drive member is arranged to have a component of movement in the axial direction of at least one of the output member and the drive wheel.

3. A drive system according to claim 1, wherein the lock mechanism includes biasing means for biasing the at least one drive member into a locked condition.

4. A drive system according to claim 1, wherein the lock mechanism includes a plurality of drive members.

5. A drive system according to claim 1, wherein the output member includes at least one formation arranged to engage with a complementary formation on the drive member.

6. A drive system according to claim 1, wherein the drive wheel includes a hub and the at least one drive member is arranged to connect the output member to the hub, thereby locking the drive wheel for rotation with the output member.

7. A drive system according to claim 6, wherein the at least one drive member is housed in the hub.

8. A drive system according to claim 7, wherein the at least one drive member is arranged for sliding movement within the hub.

9. A drive system according to claim 1, wherein the actuator means is located on the drive wheel, and preferably on the hub.

10. A drive system according to claim 1, wherein the operating handle is arranged for pivoting movement.

11. A drive system according to claim 1, wherein the transmission system includes a clutch mechanism including a plurality of roller elements arranged to drive the output member when a user drivingly actuates the at least one input member and to allow relative movement between the clutch mechanism and the output member when the at least one input member is not drivingly actuated.

12. A drive system according to claim 1, wherein the output member comprises an axle with a drive plate mounted thereon.

13. A drive system according to claim 1, wherein the at least one input member is arranged for reciprocating motion.

14. A drive system according to claim 1, including a plurality of input members.

15. A drive system according to claim 1, wherein the at least one input member comprises a lever.

16. A drive system according to claim 1, wherein the at least one input member can be rotated into a storage position without operating the transmission system.

17. A drive system according to claim 16, wherein the storage position is substantially in line with or below the level of the seat of the wheelchair.

18. A drive system according to claim 1, wherein the input member is located on the frame of the wheelchair and the position of the input member thereon is adjustable.

19. A drive system according to claim 1, wherein the transmission system includes a first pulley wheel arranged to be driven by the input member.

20. A drive system according to claim 1, including a second pulley wheel arranged to drive the output member.

21. A drive system according to claim 20, wherein drive is transmitted between the first and second pulley wheels by a pulley belt.

22. A drive system according to claim 20, including resilient means for biasing rotation of the second pulley wheel.

23. A drive system according to claim 1, including a brake system.

24. A human powered vehicle comprising a frame and a drive system coupled to the frame and including at least one input member, a transmission system arranged to convert movement of the input member to rotation of an output member, and a lock mechanism including at least one drive member for selectively locking a drive wheel to the output member for rotation therewith, wherein the lock mechanism includes manually operable actuator means for moving the at least one drive member between operational positions, and wherein the actuator means includes an operating handle having a cam surface, the arrangement being such that movement of the operating handle moves the at least one drive member into or out of engagement with the output member.

25. A vehicle according to claim 24, having at least one drive wheel including a quick release mechanism for attaching the drive wheel to the vehicle.

26. A vehicle according to claim 24, including a continuously adjustable backrest.

* * * * *